US006191349B1

(12) United States Patent
Flam

(10) Patent No.: US 6,191,349 B1
(45) Date of Patent: Feb. 20, 2001

(54) MUSICAL INSTRUMENT DIGITAL INTERFACE WITH SPEECH CAPABILITY

(75) Inventor: Maurice Flam, Bet Shemesh (IL)

(73) Assignee: International Business Machines Corporation, Armonk, NY (US)

( * ) Notice: Under 35 U.S.C. 154(b), the term of this patent shall be extended for 0 days.

(21) Appl. No.: 09/447,776

(22) Filed: Nov. 23, 1999

(30) Foreign Application Priority Data

Dec. 29, 1998 (EP) ..... 98480102

(51) Int. Cl.[7] ..... G10H 7/00; G10H 5/00
(52) U.S. Cl. ..... 84/609; 84/645; 84/649
(58) Field of Search ..... 84/600–606, 609–613, 84/622–626, 634–637, 645, 649–652, 659–660, 666–669; 704/207–208, 214, 235, 246, 251, 258, 260–261

(56) References Cited

U.S. PATENT DOCUMENTS 4,527,274 * 7/1985 Gaynor ..... 704/260
4,733,591 3/1988 Kaneko et al. .
5,471,009 11/1995 Oba et al. .
5,502,274 * 3/1996 Hotz ..... 84/613
5,869,782 * 2/1999 Shishido et al. ..... 84/609
5,915,237 6/1999 Boss et al. .
6,069,310 * 5/2000 James ..... 84/645

FOREIGN PATENT DOCUMENTS 0 509 812 A2 10/1992 (EP) .

* cited by examiner

*Primary Examiner*—Robert E. Nappi
*Assistant Examiner*—Marlon Fletcher
(74) *Attorney, Agent, or Firm*—McGinn & Gibb, P.C.; Stephen C. Kaufman

(57) ABSTRACT

A method for electronic generation of sounds, based on the notes in a musical scale, including assigning respective sounds to the notes, such that each sound is perceived by a listener as qualitatively distinct from the sound assigned to an adjoining note in the scale. An input is received indicative of a sequence of musical notes, chosen from among the notes in the scale, and an output is generated responsive to the sequence, in which the qualitatively distinct sounds are produced responsive to the respective notes in the sequence at respective musical pitches associated with the respective notes.

20 Claims, 2 Drawing Sheets

MUSICAL INSTRUMENT DIGITAL INTERFACE WITH SPEECH CAPABILITY

FIELD OF THE INVENTION

The present invention relates generally to digital interfaces for musical instruments, and specifically to methods and devices for representing musical notes using a digital interface.

BACKGROUND OF THE INVENTION

MIDI (Musical Instrument Digital Interface) is a standard known in the art that enables digital musical instruments and processors of digital music, such as personal computers and sequencers, to communicate data about musical tones. Information regarding implementing the MIDI standard is widely available, and can be found, for instance, in a publication entitled "Official MIDI Specification" (MIDI Manufacturers Association, La Habra, Calif.), which is incorporated herein by reference.

Data used in the MIDI standard typically include times of depression and release of a specified key on a digital musical instrument, the velocity of the depression, optional post-depression pressure measurements, vibrato, tremolo, etc. Analogous to a text document in a word processor, a performance by one or more digital instruments using the MIDI protocol can be processed at any later time using standard editing tools, such as insert, delete, and cut-and-paste, until all aspects of the performance are in accordance with the desires of a user of the musical editor.

Notably, a MIDI computer file, which contains the above-mentioned data representing a musical performance, does not contain a representation of the actual wave forms generated by an output module of the original performing musical instrument. Rather, the file may contain an indication that, for example, certain musical notes should be played by a simulated acoustic grand piano. A MIDI-compatible output device subsequently playing the file would then retrieve from its own memory a representation of an acoustic grand piano, which representation may be the same as or different from that of the original digital instrument. The retrieved representation is used to generate the musical wave forms, based on the data in the file.

MIDI files and MIDI devices which process MIDI information designate a desired simulated musical instrument to play forthcoming notes by indicating a patch number corresponding to the instrument. Such patch numbers are specified by the GM (General MIDI) protocol, which is a standard widely known and accepted in the art. The GM protocol specification is available from the International MIDI Association (Los Angeles, Calif.), and was originally described in an article, "General MIDI (GM) and Roland's GS Standard," by Chris Meyer, in the August, 1991, issue of *Electronic Musician,* which is incorporated herein by reference.

According to GM, 128 sounds, including standard instruments, voice, and sound effects, are given respective fixed patch numbers, e.g., Acoustic Grand Piano =1; Violin =41; Choir Aahs=53; and Telephone Ring=125. When any one of these patches is selected, that patch will produce qualitatively the same type of sound, from the point of view of human auditory perception, for any one key on the keyboard of the digital musical instrument as for any other key. For example, if the Acoustic Grand Piano patch is selected, then playing middle C and several neighboring notes produces piano-like sounds which are, in general, similar to each other in tonal quality, and which vary essentially only in pitch. (In fact, if the musical sounds produced were substantially different in any respect other than pitch, the effect on a human listener would be jarring and undesirable.)

MIDI allows information governing the performance of 16 independent simulated instruments to be transmitted effectively simultaneously through 16 logical channels defined by the MIDI standard. Of these channels, Channel 10 is uniquely defined as a percussion channel which, in contrast to the patches described hereinabove, has qualitatively distinct sounds defined for each successive key on the keyboard. For example, depressing MIDI notes 40, 41, and 42 yields respectively an Electric Snare, a Low Floor Tom, and a Closed Hi-Hat. MIDI cannot generally be used to set words to music. It is known in the art, however, to program a synthesizer, such as the Yamaha PSR310, such that depressing any key (i.e., choosing any note) within one octave yields a simulated human voice saying "ONE," with the pitch of the word "ONE" varying responsive to the particular key pressed. Pressing keys in the next higher octave yields the same voice saying "TWO," and this pattern is continued to cover the entire keyboard.

Some MIDI patches are known in the art to use a "split-keyboard" feature, whereby notes below a certain threshold MIDI note number (the "split-point" on the keyboard) have a first sound (e.g., organ), and notes above the split-point have a second sound (e.g., flute). The split-keyboard feature thus allows a single keyboard to be used to reproduce two different instruments.

SUMMARY OF THE INVENTION

It is an object of some aspects of the present invention to provide improved devices and methods for utilizing digital music processing hardware.

It is a further object of some aspects of the present invention to provide devices and methods for generating human voice sounds with digital music processing hardware.

In preferred embodiments of the present invention, an electronic musical device generates qualitatively distinct sounds, such as different spoken words, responsive to different musical notes that are input to the device. The pitch and/or other tonal qualities of the generated sounds are preferably also determined by the notes. Most preferably, the device is MIDI-enabled and uses a specially-programmed patch on a non-percussion MIDI channel to generate the distinct sounds. The musical notes may be input to the device using any suitable method known in the art. For example, the notes may be retrieved from a file, or may be created in real-time on a MIDI-enabled digital musical instrument coupled to the device.

In some preferred embodiments of the present invention, the distinct sounds comprise representations of a human voice which, most preferably, sings the names of the notes, such as "Do/Re/Mi/Fa/Sol/La/Si/Do" or "C/D/E/F/G/A/B/C," responsive to the corresponding notes generated by the MIDI instrument. Alternatively, the voice may say, sing, or generate other words, phrases, messages, or sound effects, whereby any particular one of these is produced responsive to selection of a particular musical note, preferably by depression of a pre-designated key.

Additionally or alternatively, one or more parameters, such as key velocity, key after-pressure, note duration, sustain pedal activation, modulation settings, etc., are produced or selected by a user of the MIDI instrument and are used to control respective qualities of the distinct sounds.

Further additionally or alternatively, music education software running on a personal computer or a server has the capability to generate the qualitatively distinct sounds responsive to either the different keys pressed on the MIDI instrument or different notes stored in a MIDI file. In some of these preferred embodiments of the present invention, the software and/or MIDI file is accessed from a network such as the Internet, preferably from a Web page. The music education software preferably enables a student to learn solfege (the system of using the syllables, "Do Re Mi . . . " to refer to musical tones) by playing notes on a MIDI instrument and hearing them sung according to their respective musical syllables, or by hearing songs played back from a MIDI file, one of the channels being set to play a specially-programmed solfege patch, as described hereinabove.

In some preferred embodiments of the present invention, the electronic musical device is enabled to produce clearly perceivable solfege sounds even when a pitch wheel of the device is being used to modulate the solfege sounds's pitch or when the user is rapidly playing notes on the device. Both of these situations could, if uncorrected, distort the solfege sounds or render them incomprehensible. In these preferred embodiments, the digitized sounds are preferably modified to enable them to be recognized by a listener although played for a very short time.

There is therefore provided, in accordance with a preferred embodiment of the present invention, a method for electronic generation of sounds, based on the notes in a musical scale, including:

assigning respective sounds to the notes, such that each sound is perceived by a listener as qualitatively distinct from the sound assigned to an adjoining note in the scale;

receiving an input indicative of a sequence of musical notes, chosen from among the notes in the scale; and generating an output responsive to the sequence, in which the qualitatively distinct sounds are produced responsive to the respective notes in the sequence at respective musical pitches: associated with the respective notes.

Preferably, at least one of the qualitatively distinct sounds includes a representation of a human voice. Further preferably, the distinct sounds include solfege syllables respectively associated with the notes.

Alternatively or additionally, assigning includes creating a MIDI (Musical Instrument Digital Interface) patch which includes the distinct sounds.

Further alternatively or additionally, creating the patch includes:

generating a digital representation of the sounds by digitally sampling the distinct sounds; and saving the representation in the patch.

In one preferred embodiment, receiving the input includes playing the sequence of musical notes on a musical instrument, while in another preferred embodiment, receiving the input includes retrieving the sequence of musical notes from a file. Preferably, retrieving the sequence includes accessing a network and downloading the file from a remote computer.

Preferably, generating the output includes producing the distinct sounds responsive to respective velocity parameters and/or duration parameters of notes in the sequence of notes.

In some preferred embodiments, generating the output includes accelerating the output of a portion of the sounds responsive to an input action.

There is further provided, in accordance with a preferred embodiment of the present invention, a method for electronic generation of sounds, based on the notes in a musical scale, including:

assigning respective sounds to at least several of the notes, such that each assigned sound is perceived by a listener as qualitatively distinct from the sound assigned to an adjoining note in the scale;

storing the assigned sounds in a patch to be played on a non-percussion channel as defined by the Musical Instrument Digital Interface standard;

receiving a first input indicative of a sequence of musical notes, chosen from among the notes in the scale;

receiving a second input indicative of one or more keystroke parameters, corresponding respectively to one or more of the notes in the sequence; and generating an output responsive to the sequence, in which the qualitatively distinct sounds are produced responsive to the first and second inputs.

Preferably, assigning the sounds includes assigning respective representations of a human voice pronouncing one or more words.

There is also provided, in accordance with a preferred embodiment of the present invention, apparatus for electronic generation of sounds, based on notes in a musical scale, including:

an electronic music generator, including a memory in which data are stored indicative of respective sounds that are assigned to the notes, such that each sound is perceived by a listener as qualitatively distinct from the sound assigned to an adjoining note in the scale, and receiving (a) a first input indicative of a sequence of musical notes, chosen from among the notes in the scale; and (b) a second input indicative of one or more keystroke parameters, corresponding to one or more of the notes in the sequence; and a speaker, which is driven by the device to generate an output responsive to the sequence, in which the qualitatively distinct sounds assigned to the notes in the scale are produced responsive to the first and second inputs.

Preferably, at least one of the qualitatively distinct sounds includes a representation of a human voice. Further preferably, the distinct sounds include respective solfege syllables.

Preferably, the data are stored in a MIDI patch. Further preferably, in the output generated by the speaker, the sounds are played at respective musical pitches associated with the respective notes in the scale.

In a preferred embodiment of the present invention, a system for musical instruction includes an apparatus as described hereinabove. In this embodiment, the sounds preferably include words descriptive of the notes.

The present invention will be more fully understood from the following detailed description of the preferred embodiments thereof.

DETAILED DESCRIPTION OF PREFERRED EMBODIMENTS

Figure 1:
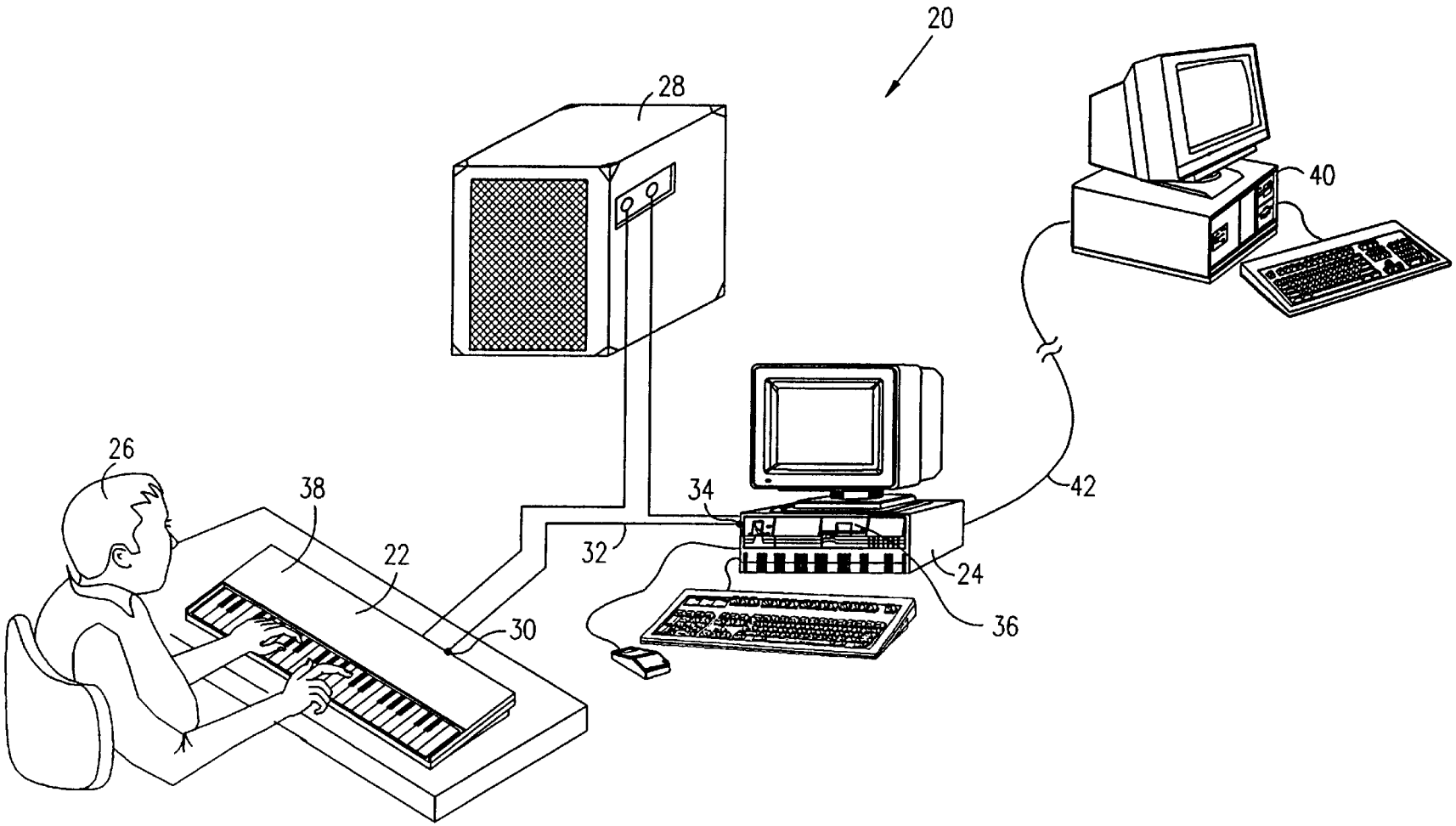
FIG. 1 is a schematic illustration of a system for generating sounds, in accordance with a preferred embodiment of the present invention.

FIG. 1 is a schematic illustration of a system 20 for generating sounds, comprising a processor 24 coupled to a digital musical instrument 22, an optional amplifier 28, which preferably includes an audio speaker, and an optional music server 40, in accordance with a preferred embodiment of the present invention. Processor 24 and instrument 22 generally act as music generators in this embodiment. Processor 24 preferably comprises a personal computer, a sequencer, and/or other apparatus known in the art for processing MIDI information. It will be understood by one skilled in the art that the principles of the present invention, as described hereinbelow, may also be implemented by using instrument 22 or processor 24 independently. Additionally, preferred embodiments of the present invention are described hereinbelow with respect to the MIDI standard in order to illustrate certain aspects of the present invention; however, it will be further understood that these aspects could be implemented using other digital or mixed digital/analog protocols.

Typically, instrument 22 and processor 24 are connected by standard cables and connectors to amplifier 28, while a MIDI cable 32 is used to connect a MIDI port 30 on instrument 22 to a MIDI port 34 on processor 24. For some applications of the present invention, to be described in greater detail hereinbelow, processor 24 is coupled to a network 42 (for example, the Internet) which allows processor 24 to download MIDI files from music server 40, also coupled to the network.

In a preferred mode of operation of this embodiment of the present invention, digital musical instrument 22 is MIDI-enabled. Using methods described in greater detail hereinbelow, a user 26 of instrument 22 plays a series of notes on the instrument, for example, the C major scale, and the instrument causes amplifier 28 to generate, responsive thereto, the words "Do Re Mi Fa Sol La Si Do," each word "sung," i.e., pitched, at the corresponding tone. Preferably, the solfege thereby produced varies according to some or all of the same keystroke parameters or other parameters that control most MIDI instrumental patches, e.g., key velocity, key after-pressure, note duration, sustain pedal activation, modulation settings, etc.

Alternatively or additionally, user 26 downloads from server 40 into processor 24 a standard MIDI file, not necessarily prepared specifically for use with this invention. For example, while browsing, the user may find an American history Web page with a MIDI file containing a monophonic rendition of "Yankee Doodle," originally played and stored using GM patch 73 (Piccolo). ("Monophonic" means that an instrument outputs only one tone at a time.) After downloading the file, processor 24 preferably changes the patch selection from 73 to a patch which is specially programmed according to the principles of the present invention (and not according to the GM standard). As a result, upon playback the user hears a simulated human voice singing "Do Do Re Mi Do Mi Re . . . ," preferably using substantially the same melody, rhythms, and other MIDI parameters that were stored with respect to the original digital Piccolo performance. Had the downloaded MIDI file been multi-timbral, e.g., Piccolo (patch 73) on Channel 1 playing the melody, Banjo (patch 106) on Channel 2accompanying the Piccolo, and percussion on Channel 10, then user 26 would have the choice of hearing the solfege of either Channel 1 or Channel 2 by directing that the notes and data from the chosen Channel be played by a solfege patch. If, in this example, the user chooses to hear the solfege of Channel 1, then the Banjo and percussion can still be heard simultaneously, substantially unaffected by the application of the present invention to the MIDI file.

For some applications of the present invention, a patch relating each key on the keyboard to a respective solfege syllable (or to other words, phrases, sound effects, etc.) is downloaded from server 40 to a memory 36 in processor 24. User 26 preferably uses the downloaded patch in processor 24, and/or optionally transfers the patch to instrument 22, where it typically resides in an electronic memory 38 thereof. From the user's perspective, operation of the patch is preferably substantially the same as that of other MIDI patches known in the art.

In a preferred embodiment of the present invention, the specially-programmed MIDI patch described hereinabove is used in conjunction with educational software to teach solfege and/or to use solfege as a tool to teach other aspects of music, e.g., pitch, duration, consonance and dissonance, sight-singing, etc. In some applications, MIDI-enabled Web pages stored on server 40 comprise music tutorials which utilize the patch and can be downloaded into processor 24 and/or run remotely by user 26.

Figure 2:
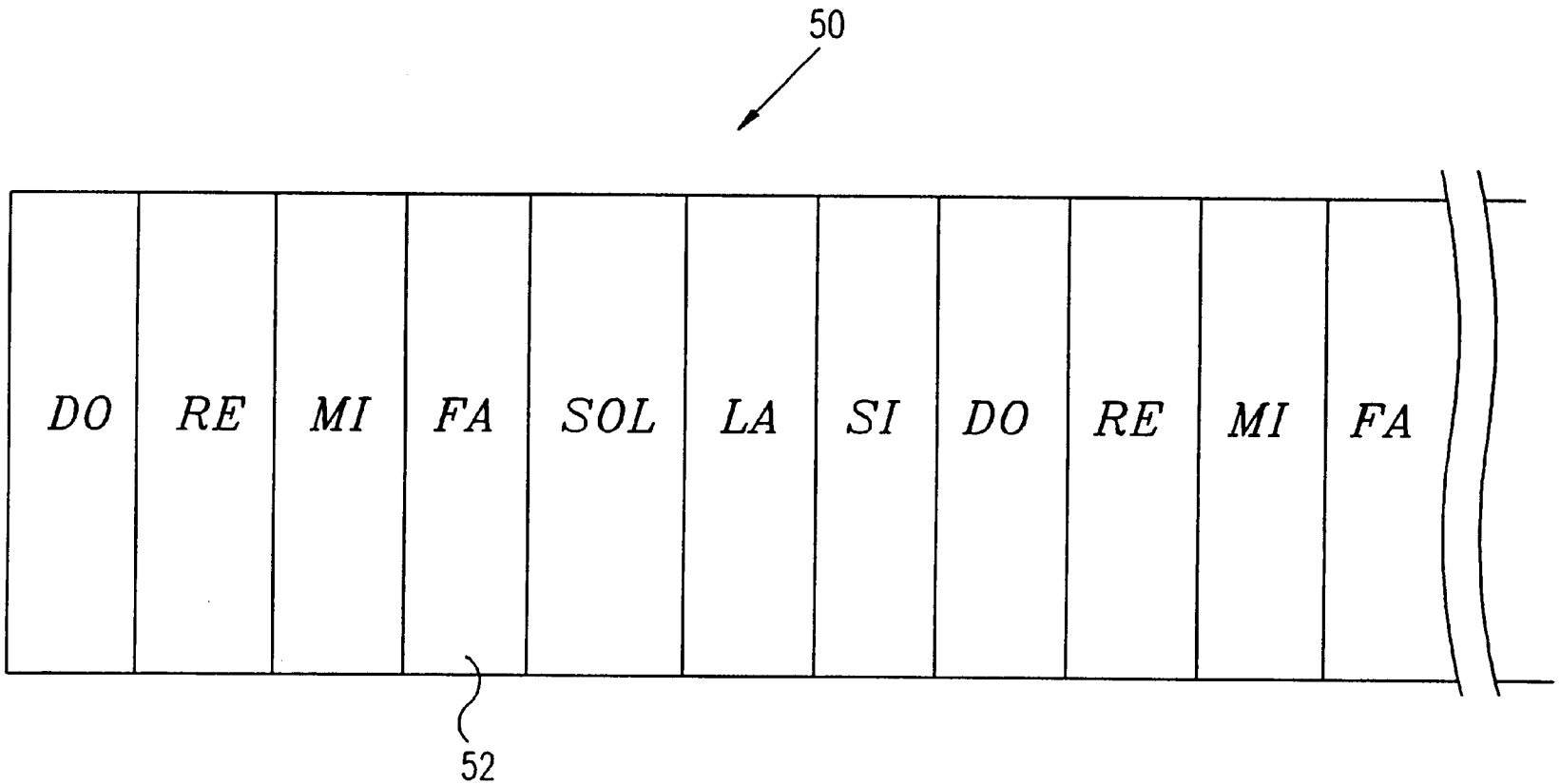
FIG. 2 is a schematic illustration of a data structure utilized by the system of FIG. 1, in accordance with a preferred embodiment of the present invention.

FIG. 2 is a schematic illustration of a data structure 50 for storing sounds, utilized by system 20 of FIG. 1, in accordance with a preferred embodiment of the present invention. Data structure 50 is preferably organized in the same general manner as MIDI patches which are known in the art. Consequently, each block 52 in structure 50 preferably corresponds to a particular key on digital musical instrument 22 and contains a functional representation relating one or more of the various MIDI input parameters (e.g., MIDI note, key depression velocity, after-pressure, sustain pedal activation, modulation settings, etc.) to an output. The output typically consists of an electrical signal which is sent to amplifier 28 to produce a desired sound.

However, unlike MIDI patches known in the art, structure 50 comprises qualitatively distinct sounds for a set of successive MIDI notes. A set of "qualitatively distinct sounds" is used in the present patent application and in the claims to refer to a set of sounds which are perceived by a listener to differ from each other most recognizably based on a characteristic that is not inherent in the pitch of each of the sounds in the set. Illustrative examples of sets of qualitatively different sounds are given in Table I. In each of the sets in the table, each of the different sounds is assigned to a different MIDI note and (when appropriate) is preferably "sung" by amplifier/speaker 28 at the pitch of that note when the note is played.

TABLE I 1. (Human voice):
{"Do", "Re", "Mi", "Fa", "Sol", "La", "Si"} - as illustrated in FIG. 2
2. (Human voice):
{"C", "C♯", "D", "D♯", "E", "F", "F♯", "G", "G♯", "A", "A♯", "B"}
3. (Human voice):
{"1", "2", "3", "4", "5", "6", "7", "8", "9", "10", "11", "12", "13", "14", "15", "plus", "minus", "times", "divided by", "equals", "point"}
4. (Sound effects):
[Beep], [Glass shattering], [Sneeze], [Car honk], [Referee's whistle]}

Thus, a MIDI patch made according to the principles of the present invention is different from MIDI patches known in the art, in which pitch is the most recognizable characteristic (and typically the only recognizable characteristic) which perceptually differentiates the sounds generated by playing different notes, particularly several notes within one octave. It is noted that although data structure 50 is shown containing the sounds "Do Re Mi . . . ," any of the entries in Table I above, or any other words, phrases, messages, and/or sound effects could be used in data structure 50 and are encompassed within the scope of the present invention.

Each block 52 in data structure 50 preferably comprises a plurality of wave forms to represent the corresponding MIDI note. Wave Table Synthesis, as is known in the art of computerized music synthesis, is the preferred method for generating data structure 50.

Alternatively or additionally, a given block 52 in structure 50, for example "Fa," is prepared by digitally sampling a human voice singing "Fa" at a plurality of volume levels and for a plurality of durations. Interpolation between the various sampled data sets, or extrapolation from the sampled sets, is used to generate appropriate sounds for non-sampled inputs.

Further alternatively or additionally, only one sampling is made for each entry in structure 50, and its volume or other playback parameters are optionally altered in real-time to generate solfege based on the MIDI file or keys being played. For some embodiments of the present invention, blocks corresponding to notes separated by exactly one octave have substantially the same wave forms. In general, preparation of structure 50 in order to make a solfege patch is analogous to preparation of any digitally sampled instrumental patch known in the art (e.g., acoustic grand piano), except that, as will be understood from the disclosure hereinabove, no interpolation is generally performed between two relatively near MIDI notes to determine the sounds of intermediate notes.

In some applications, instrument 22 includes a pitch wheel, known in the art as a means for smoothly modulating the pitch of a note, typically in order to allow user 26 to cause a transition between one solfege sound and a following solfege sound. In some of these applications, it is preferable to divide the solfege sounds into components, as described hereinbelow, so that use of the pitch wheel does not distort the sounds. Spoken words generally have a "voiced" part, predominantly generated by the larynx, and an "unvoiced" part, predominantly generated by the teeth, tongue, palate, and lips. Typically, the voiced part of speech can vary significantly in pitch, while the unvoiced part is relatively unchanged with modulations in the pitch of a spoken word.

Therefore, in a preferred embodiment of the present invention, synthesis of the sounds is adapted in order to enhance the ability of a listener to clearly perceive each solfege sound as it is being output by amplifier 28, even when the user is operating the pitch wheel (which can distort the sounds) or playing notes very quickly (e.g., faster than about 6 notes/second). In order to achieve this object, instrument 22 regularly checks for input actions such as fast key-presses or use of the pitch wheel. Upon detecting one of these conditions, instrument 22 preferably accelerates the output of the voiced part of the solfege sound, most preferably generating a substantial portion of the voiced part in less than about 100 ms (typically in about 15 ms). The unvoiced part is generally not modified in these cases. The responsiveness of instrument 22 to pitch wheel use is preferably deferred until after the accelerated sound is produced.

Dividing a spoken sound into its voiced and unvoiced parts, optionally altering one or both of the parts, and subsequently recombining the parts is a technique well known in the art. Using known techniques, acceleration of the voiced part is typically performed in such a manner that the pitch of the voiced part is not increased by the acceleration of its playback.

Alternatively, the voiced and unvoiced parts of each solfege note are evaluated prior to playing instrument 22, most preferably at the time of initial creation of data structure 50. In this latter case, both the unmodified digital representation of a solfege sound and the specially-created "accelerated" solfege sound are typically stored in block 52, and instrument 22 selects whether to retrieve the unmodified or accelerated solfege sound based on predetermined selection parameters.

In some applications of the present invention, acceleration of the solfege sound (upon pitch wheel use or fast key-presses) is performed without separation of the voiced and unvoiced parts. Instead, substantially the entire representation of the solfege sound is accelerated, preferably without altering the pitch of the sound, such that the selected solfege sound is clearly perceived by a listener before the sound is altered by the pitch wheel or replaced by a subsequent solfege sound.

Alternatively, only the first part of a solfege sound (e.g., the "D" in "Do" ) is accelerated, such that, during pitch wheel operation or rapid key-pressing, the most recognizable part of the solfege sound is heard by a listener before the sound is distorted or a subsequent key is pressed.

It will be appreciated generally that the preferred embodiments described above are cited by way of example, and the full scope of the invention is limited only by the claims.

What is claimed is:

1. A method for electronic generation of sounds, based on notes in a musical scale, comprising:

assigning respective sounds to said notes, such that each sound is perceived by a listener as qualitatively distinct from a sound assigned to an adjoining note in said musical scale by creating a Musical Instrument Digital Interface (MIDI) patch which comprises qualitatively distinct sounds;

receiving an input indicative of a sequence of said notes, chosen from among said notes in said musical scale; and generating an output responsive to said sequence, in which said qualitatively distinct sounds are produced responsive to respective notes in said sequence at respective musical pitches associated with said respective notes.

2. A method according to claim 1, wherein at least one of said qualitatively distinct sounds comprises a representation of a human voice.

3. A method according to claim 2, wherein said qualitatively distinct sounds comprise solfege syllables respectively associated with said notes.

4. A method according to claim 1, wherein said creating of said MIDI patch comprises:

generating a digital representation of said sounds by digitally sampling said qualitatively distinct sounds; and saving said digital representation in said MIDI patch.

5. A method according to claim 1, wherein said receiving said input comprises playing said sequence of notes on a musical instrument.

6. A method according to claim 1, wherein said receiving said input comprises retrieving said sequence of notes from a file.

7. A method according to claim 6, wherein said retrieving comprises accessing a network and downloading said file from a remote computer.

8. A method according to claim 1, wherein said generating of said output comprises producing said qualitatively distinct sounds responsive to respective duration parameters of notes in said sequence of notes.

9. A method according to claim 1, wherein said generating of said output comprises producing said qualitatively distinct sounds responsive to respective velocity parameters of notes in said sequence of notes.

10. A method according to claim 1, wherein said generating of said output comprises accelerating an output of a portion of sounds responsive to an input action.

11. A method according to claim 1 wherein said qualitatively distinct sounds comprise sounds which differ from each other based on a characteristic that is not inherent in a pitch of each of said sounds.

12. A method for electronic generation of sounds, based on notes in a musical scale, comprising:

assigning respective sounds to at least several of said notes, such that each assigned sound is perceived by a listener as qualitatively distinct from a sound assigned to an adjoining note in said musical scale;

storing said assigned sounds in a patch to be played on a non-percussion channel as defined by a Musical Instrument Digital Interface standard;

receiving a first input indicative of a sequence of notes, chosen from among said notes in said musical scale;

receiving a second input indicative of one or more keystroke parameters, corresponding respectively to one or more of said notes in said sequence; and generating an output responsive to said sequence, in which said qualitatively distinct sounds are produced responsive to said first and second inputs.

13. A method according to claim 12, wherein said assigning said sounds comprises assigning respective representations of a human voice pronouncing one or more words.

14. A method according to claim 12, wherein said qualitatively distinct sounds comprise sounds which differ from each other based on a characteristic that is not inherent in a pitch of each of said sounds.

15. An apparatus for electronic generation of sounds, based on notes in a musical scale, comprising:

an electronic music generator, comprising a memory in which data are stored indicative of respective sounds that are assigned to said notes, such that each sound is perceived by a listener as qualitatively distinct from a sound assigned to an adjoining note in said musical scale, and receiving: (a) a first input indicative of a sequence of notes, chosen from among said notes in said musical scale; and (b) a second input indicative of one or more keystroke parameters, corresponding to one or more of said notes in said sequence; and a speaker, which is driven by said apparatus to generate an output responsive to said sequence, in which said qualitatively distinct sounds assigned to said notes in said musical scale are produced responsive to said first input and a second input, wherein said data is stored in a Musical Instrument Digital Interface patch.

16. An apparatus according to claim 15, wherein at least one of said qualitatively distinct sounds comprises a representation of a human voice.

17. An apparatus according to claim 16, wherein said qualitively distinct sounds comprise respective solfege syllables.

18. An apparatus according to claim 15, wherein in said output generated by said speaker, said sounds are played at respective musical pitches associated with respective notes in said musical scale.

19. A system for musical instruction, comprising an apparatus according to claim 18, wherein said sounds comprise words descriptive of said notes.

20. A method according to claim 15, wherein said qualitatively distinct sounds comprise sounds which differ from each other based on a characteristic that is not inherent in a pitch of each of said sounds.

* * * * *